US005477615A

United States Patent [19]

Wakao

[11] Patent Number: 5,477,615

[45] Date of Patent: Dec. 26, 1995

[54] SHARP CUTTER

[76] Inventor: Hiroshi Wakao, 3-151 Onada Cho, Tajimi-shi, Gifu-ken, Japan

[21] Appl. No.: 991,183

[22] Filed: Dec. 15, 1992

[51] Int. Cl.[6] ..... B26B 9/00

[52] U.S. Cl. ..... 30/329; 30/162; 30/342

[58] Field of Search ..... 30/162, 335, 329, 30/332, 333, 342, 346.57, 346.59, 349, 287, 294; 401/57, 90; 206/234, 349

[56] References Cited

U.S. PATENT DOCUMENTS

| | | | |
|---|---|---|---|
| 866,995 | 9/1907 | Wright | 206/234 |
| 1,274,966 | 8/1918 | Wentz | 30/294 |
| 1,541,078 | 6/1925 | Sudweeks | 30/366 |
| 3,761,188 | 9/1973 | Chin-Chih | 401/57 |
| 3,889,368 | 6/1975 | Himeno | 30/335 |
| 4,660,287 | 4/1987 | Decker | 30/162 |
| 4,663,846 | 5/1987 | Takayama | 30/162 |
| 4,729,168 | 3/1988 | Yeh | 30/162 |
| 5,014,429 | 5/1991 | McNamara | 30/335 |

*Primary Examiner*—Richard K. Seidel
*Assistant Examiner*—Allan M. Schrock

[57] ABSTRACT

A cutter includes a container having openings at the top and at the bottom, and a removable cap that fits frictionally over the top opening. Inside the container is a plurality of units, each unit including a capsule with a blade member fixedly joined to and projecting from the capsule. These units fit frictionally atop one another in a nesting relationship inside the container with the blade member of one unit being received within a hollow opening in another unit.

3 Claims, 1 Drawing Sheet

SHARP CUTTER

This invention relates to a sharp cutter. For safety, this cutter includes protective covers around its blades. The blade replacement mechanism of this cutter can include several different types of blades such as pointed head blades, slanted head blades, and flat head blades to address different cutting tasks.

By contrast, prior blade cutters present dangers to the user. For example, once the head of a blade in such cutters is blunted through use, the user must break off the used blade part to expose a new blade part. In so doing, broken blade pieces can cut the user's hand, or another part of his body. After a blade is consumed, the user must disassemble the cutter to insert a new blade. The new cutter eliminates those problems, and provides a soft touch for making precise cuts.

Since the new cutter has a system of replacing blades, no snap off action is necessary. The user instead removes a used blade from the top of the container, and inserts the used blade into an opening at the rear of the container.

The container for the new cutter includes a removable top cap. Removing the top cap provides access to the blade on top. After consumption through use, the top blade is removed, and inserted into the opening at the rear of the container. Removing the uppermost, used blade exposes a new blade for use. After all blades in the container are consumed, the user can insert a new set of blades into the opening at the rear of the container.

BRIEF DESCRIPTION OF THE DRAWINGS

The sharp cutter of this invention can better be understood by reference to the drawings, in which.

DETAILED DESCRIPTION OF THE PREFERRED EMBODIMENT

Figure 1:
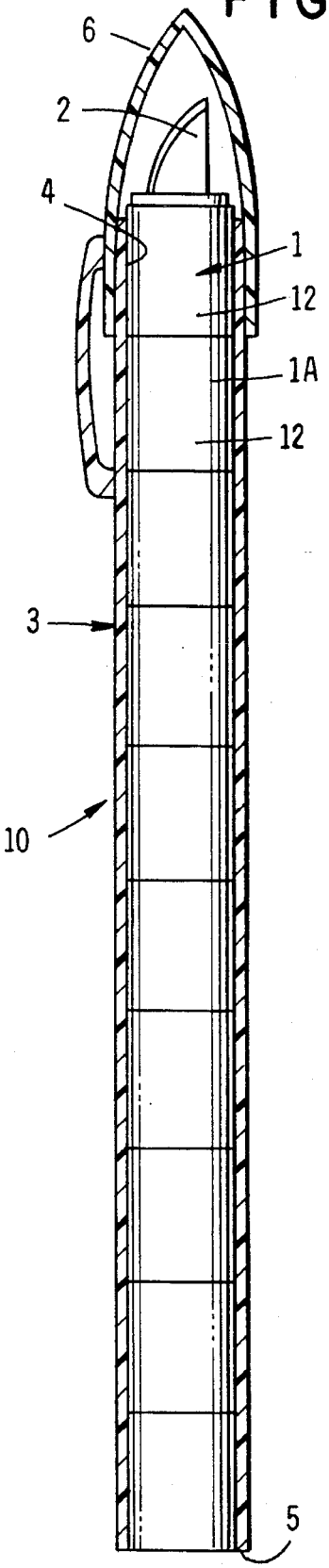
FIG. 1 is a perspective view of the container and container top of a preferred embodiment of the new rotating cutter.
Figure 2:
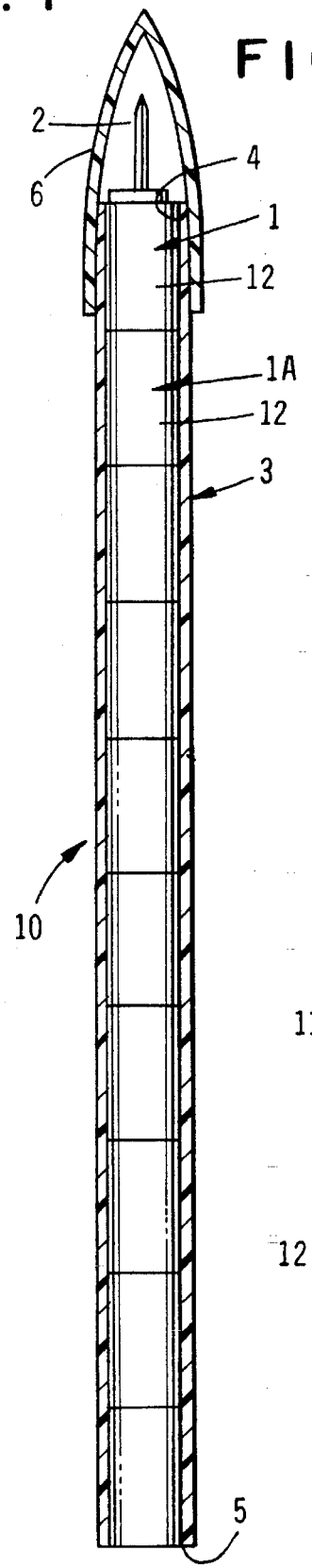
FIG. 2 is a first side elevation view in cross section of the embodiment shown in FIG. 1.
Figure 3:
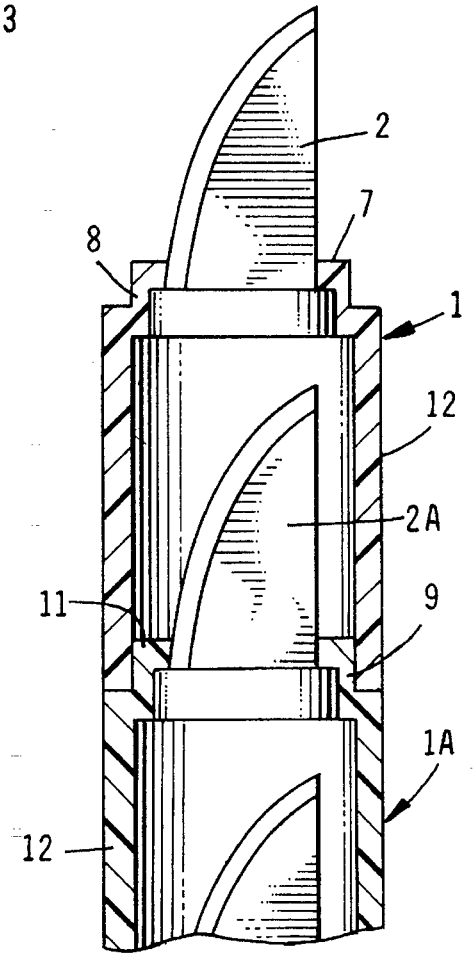
FIG. 3 is a second side elevation view in cross section of the embodiment shown in FIG. 1.

FIGS. 1, 2 and 3 show an embodiment of the new cutter 10. Cutter 10 includes a number of blades 2, each individually attached to cylindrical capsule 1. A plurality of the blade-and-capsule units are stacked one above the other in a handy container 3. Cylindrical container 3 includes rear opening 5 for insertion of blades 2, and top opening 4 for exposure, use and removal of consumed blade-and-capsule units 1, 2. Top opening 4 includes cap 6 as a cover for exposed top blade 2 and container 3.

FIG. 3 shows an exploded detail view of the blade and capsule units 1, 2. Capsule unit 1 has an integrally-formed, thermoplastic cylindrical sidewall 12. Atop sidewall 12 is transverse member 7. Member 7 is joined to cylindrical sidewall 8, which has a smaller outer diameter than the outer diameter of cylindrical sidewall 12. The outer diameter of sidewall 8 is slightly smaller than the inner diameter of sidewall 12, and is adapted to fit frictionally, and snugly, within sidewall 12. Blade-and-capsule unit 1A includes transverse member 11 joined to cylindrical sidewall 9. Member 11 and sidewall 9 are substantially the same size and shape as member 7 and sidewall 8, respectively. Blade 2A is fixedly embedded, as by molding, in member 11, just as blade 2 is fixedly embedded in member 7. Sidewall 12 fits frictionally over sidewall 9, with blade 2A extending into the hollow space inside sidewall 12. Other capsule and blade units of similar size and shape are stacked in a nesting relationship beneath the two units shown in FIG. 3 to form a column of such units, as seen in FIGS. 1 and 2.

What is claimed is:

1. A sharp cutter includes a container having an inner wall, an outer wall, a first end, a second end, a top opening at a first end, and a removable cap for said one end; a plurality of units disposed inside said container, each unit comprising a capsule including a cutting blade member projecting from, and fixedly joined to, said capsule, said units being adapted to fit atop one another in a nesting relationship inside of, and against the inner wall of said container; at the second end of said container opposite said top opening, a bottom opening in said second end adapted to receive said units in said nesting relationship, wherein any one capsule is adapted to cover the cutting blade member projecting from another capsule when said another capsule is frictionally fit into said any one capsule.

2. The cutter of claim 1 wherein said container is cylindrical in shape, each of said capsules is cylindrical in shape and has a transverse member across one end with said cutting blade member projecting thereform, each of said capsules includes a hollow space beneath said transverse member, said hollow space enclosing said cutting blade member projecting from said another capsule when said any one capsule is frictionally fit atop said another capsule.

3. The cutter of claim 1 in which said capsule is made of injection-molded plastic.

* * * * *